United States Patent [19]

Moen

[11] Patent Number: 4,596,542

[45] Date of Patent: Jun. 24, 1986

[54] MANUFACTURE OF INTERNALLY REINFORCED BOXES

[76] Inventor: Lenard E. Moen, 7914 Michigan, Whitter, Calif. 90602

[21] Appl. No.: 655,411

[22] Filed: Sep. 28, 1984

[51] Int. Cl.[4] ..... B31B 11/26; B31B 1/44; B31B 1/28; B31B 1/52

[52] U.S. Cl. ..... 493/89; 493/167; 493/176

[58] Field of Search ..... 493/89, 92, 98, 167, 493/175, 176, 449, 456, 168, 169, 417; 229/31 FS, 34 R, 23 R

[56] References Cited

U.S. PATENT DOCUMENTS

| | | | |
|---|---|---|---|
| 651,982 | 6/1900 | Smith | 493/89 |
| 2,772,609 | 12/1956 | Bray et al. | 493/89 |
| 2,811,086 | 10/1957 | Hollis | 493/167 |
| 2,856,826 | 10/1958 | Norquist et al. | 493/417 |
| 3,635,129 | 1/1972 | Cobelo, Jr. | 493/167 |
| 3,659,505 | 5/1972 | Wasyluka et al. | 493/169 |
| 3,673,928 | 7/1972 | Striplin | 493/167 |
| 4,023,471 | 5/1977 | Royal | 493/167 |
| 4,052,933 | 10/1977 | Royal | 493/171 |
| 4,283,188 | 8/1981 | Wingerter et al. | 493/89 |

OTHER PUBLICATIONS

"SWF Box-Matic Specifications", *SWF Machinery,* 7/1976 (brochure).

"Moen PF106-BIFQ", *Moen Industries,* 10/1982 (brochure).

"Series IPF 72 Fully Automatic Corrugated Board Traymaker", *Packaging Digest,* 2/1984 (advertisement), p. 79.

*Primary Examiner*—Francis S. Husar
*Assistant Examiner*—William E. Terrell
*Attorney, Agent, or Firm*—Frederick E. Mueller

[57] ABSTRACT

A mandrel has its face formed to define a negative impression of reinforcing elements to be formed into the walls of a Bliss box. The reinforcing elements may comprise tubular corner posts and/or intermediate hollow ribs or posts. The mandrel is mounted in a machine frame for reciprocation along its axis so that upon full extension of the mandrel it is disposed within a die cavity in which the Bliss body panel is formed around a pair of upstanding end panels. When fully retracted, the mandrel is positioned beneath and adjacent to a pair of magazines for holding supplies of flat end panel blanks, positioned on opposite sides of a superstructure frame of the mandrel. The superstructure is fitted with spaced pairs of feed pawls, a first set of which strips the flat end panels out of the supply magazines to deliver them to an arrested position, corresponding to the retracted position of the mandrel, as a result of extension of the mandrel. Concurrently, the flaps of each end panel are partially shoed inwardly. Upon subsequent full retraction of the mandrel, the partially folded flaps of the end panels are folded into and have portions formed by post defining impressions of the mandrel face. Upon a subsequent extension of the mandrel, a pair of thus fully formed end panels are fed into the die cavity along with a pre-glued body blank which is erected thereby.

21 Claims, 25 Drawing Figures

MANUFACTURE OF INTERNALLY REINFORCED BOXES

BACKGROUND OF THE INVENTION

The present invention relates to the manufacture of boxes or containers out of corrugated paper or similar sheet material. More particularly, the invention relates to the manufacture of Bliss style boxes having a pair of end panels having flaps configured to define hollow corner posts and/or intermediate post reinforcements along with the end flaps and side walls of the body wrap.

A conventional Bliss box comprises a pair of rectangular end wall panels, each having marginal side and bottom areas secured to end flaps of a body wrap, the body wrap also defining the bottom and side walls of the completed box. The stacking strength of a Bliss box is superior to that of a conventional tray container but recently there have been efforts to further increase the stacking strength of the Bliss style container.

In one such attempt, each of the Bliss box end panels, prior to being brought into registration with the body wrap, has a pair of marginal flaps thereof turned inwardly to define a right angle corner post when the marginal flap is laminated, stapled or glued to the sidewall of the body wrap. In another modification, each of the end panel blanks, prior to being brought into registration with the body wrap, has a pair of marginal flaps thereof turned inwardly around a mandrel to define both a diagonal corner post and an internal marginal flap at each corner of the box when the body wrap is formed therearound on the mandrel. In another improvement, as shown in my application Ser. No. 636,917, each end panel blank is formed with an opposite end pair of flaps, each flap being subdivided into at least three areas. Each of these subdivided flaps is folded and glued to the central area of the end panel to define a hollow right triangle corner post and/or a hollow triangular intermediate post in the end wall. The completed end wall, thus preformed, is then upended and stripped from its magazine by a descending mandrel to be brought into proper registration with the Bliss body wrap to be formed therearound in the die cavity.

While machines utilizing the techniques just described have come into commercial use, the results have not been entirely satisfactory. The merely internally flanged style of Bliss box provides only a modest increase in stacking strength and does not compartmentalize the interior of the box. The Bliss box with internal flanges and diagonal corners in the end panels is an improvement in terms of stacking strength but does not compartmentalize the interior of the box and is required to be made on a machine in which the fluid cylinder for reciprocating the mandrel requires a very long stroke. The machine of my prior application results in a Bliss box having hollow corner and/or intermediate reinforcement posts and thus greatly improves the stacking strength of the box while also compartmentalizing the box. However, the mode of operation is relatively complex, involving as it does the pre-formation and gluing of the corner posts and/or intermediate posts around auxiliary mandrels prior to the feeding of the completed end panel to the machine mandrel.

SUMMARY OF THE INVENTION

The invention provides a process and machine for forming Bliss boxes with internal reinforcing and compartmentalizing elements in the form of hollow corner and intermediate posts of triangular cross sectional configuration in conjunction with the end flaps and sidewalls of the body wrap.

An essentially polyhedral or prismatic mandrel is formed with a series of concave and convex flat faces to define a negative impression of a series of hollow triangular corner and/or intermediate posts desired in the final Bliss box. The mandrel is mounted for reciprocation along its axis into and out of a die cavity. A superstructure of the mandrel, on the opposite side thereof from the die cavity, is fitted on opposite sides thereof with spaced sets of pawls. Upon a first extension of the mandrel into the die cavity, the outermost set of pawls strips a pair of end panels out of corresponding feed magazines or hoppers to deliver them into an arrested position between the die cavity and the supply magazines. During the course of this movement each of the end flaps of an end panel is cammed inwardly approximately 60° and a corner post element is formed. While the partially formed end panels are held stationary, subsequent retraction of the mandrel brings it within the partially formed end panels. Thereupon, rib folding mechanisms, one situated adjacent each corner of the mandrel, effect folding of areas of the flap into registration with indented or concave faces of the mandrel. Upon subsequent extension of the mandrel initiating a second stroke thereof, the innermost set of pawls delivers the preformed or fully folded end panels into registration with the bottom panel area of the flat body blank. Continued extension of the mandrel drives the fully folded end panels and body blank into the die cavity whereupon preglued areas of the body blank end flaps and side walls are fully formed into contact with the end panels. Simultaneously, a second set of partially folded end panels has been brought into the previously stated arrested position by the outermost set of pawls. Upon subsequent retraction of the mandrel out of the die cavity and out of the fully formed Bliss box, the second set of end panels is fully formed around the mandrel after the mandrel arrives in its fully retracted position.

Adjacent each corner of the mandrel the machine frame stationarily supports a camming element, such as a shoe, configured to effect sequential folding of marginal flap areas along the score lines defining these areas. Disposed adjacent each of these camming elements is an extendable and retractable rib forming shoe swingable into and out of registration with one of the concave indentations of the mandrel. Each of the swingable shoes is adapted to work in opposition to a corresponding spring loaded plate carried in one of the mandrel faces at the corner. In a retracted position of the shoe, the apical portion of each comprises essentially a continuation of a corresponding cam shoe.

DESCRIPTION OF THE PREFERRED AND ALTERNATIVE EMBODIMENTS

Figure 1:
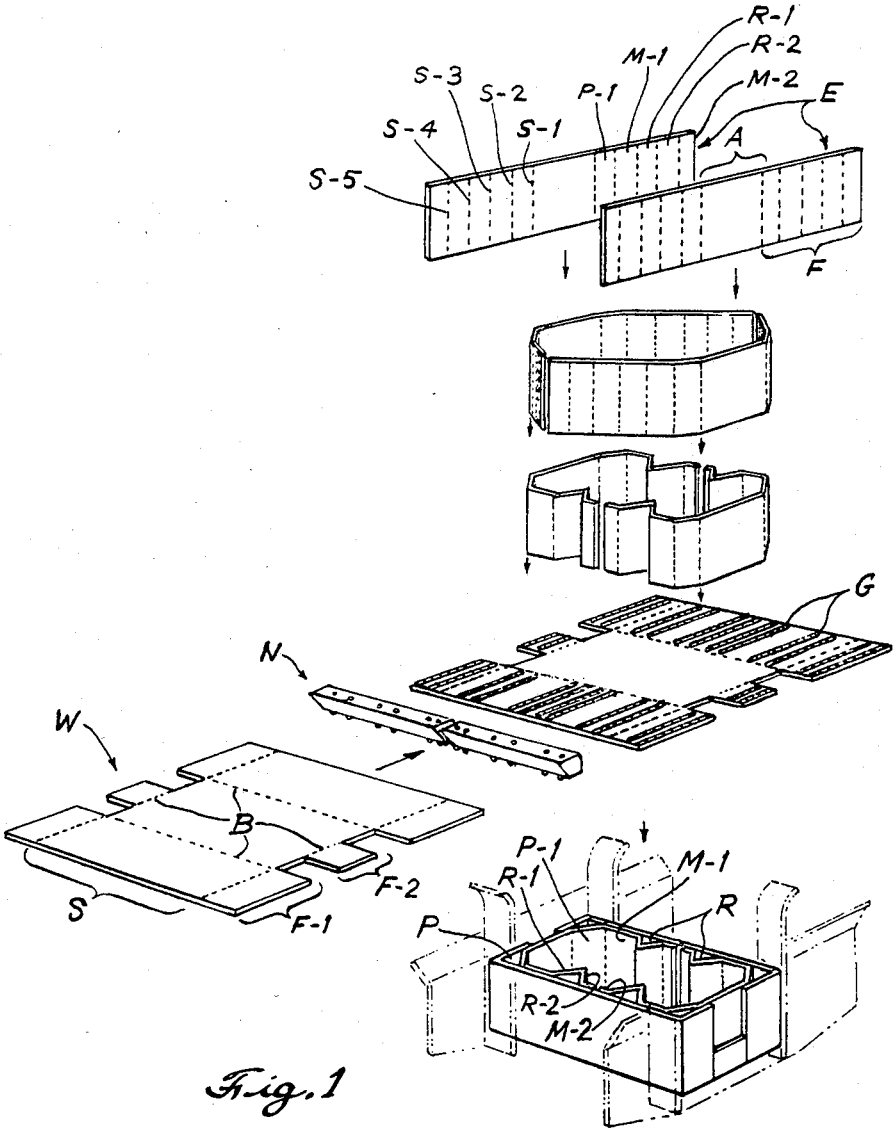
FIG. 1 is a flow diagram illustrating a process of making internally reinforced Bliss boxes in accordance with the invention.
Figure 2:
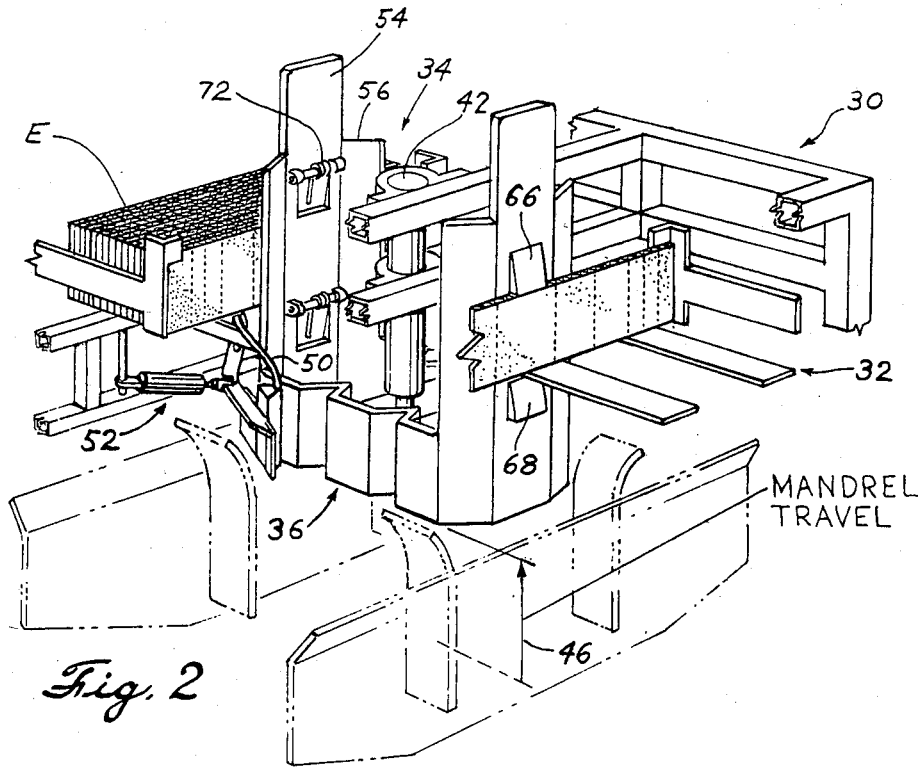
FIGS. 2–5 are partial perspective views of one embodiment of machinery of the invention, showing the parts in different relative positions and illustrating the sequence of certain steps in the process of the invention.

Before explaining the invention in detail, it is to be understood that the invention is not limited in its application to the steps, details of construction and the arrangements of components set forth in the description or illustrated in the drawings. The invention is capable of other embodiments and of being practiced and carried out in various ways. Also, it is to be understood that the phraseology and terminology employed herein is for the purposes of description and should not be regarded as limiting.

FIG. 1 is a diagramatic presentation of certain steps in the process of the invention. By way of example of one of a great variety of Bliss boxes that can be made with the invention, the figure shows a Bliss container L that is internally reinforced by four corner posts P and four intermediate ribs R. Each of the posts P and R is of hollow triangular cross sectional configuration and it will be observed that these reinforcements define compartments within the box.

As is well known, a Bliss box is typically made of three components. In the illustrated case the box is made of a pair of preformed flat rectangular end panels E and a preformed body wrap or blank W.

Each end panel E is formed, on that face or side thereof which faces inwardly in the comleted box, with a series of score lines to define a pair of flap areas F on opposite ends of a central wall area A, with each of the flaps F also being subdivided by the scorelines. More particularly, the blank E is formed with a series of scorelines S-1 through S-5 proceeding outwardly from the central wall area A towards the terminal edge of the flaps. As will appear from an examination of FIG. 1, the area P-1 of each flap F between the scorelines S-1 and S-2 will become an element of a corner post P; the area between the scorelines S-2. and S-3 and between scorelines S-5 and the terminal outer edge of the flap F will become laminator tabs M-1 and M-2, respectively, adhesively secured to portions of the body wrap W; and the two adjacent areas between the scorelines S-3, S-4 and S-5 will become rib elements R-1 and R-2 of the completed post R, in conjunction with side wall portions of the body wrap W.

Depending on the thickness, stiffness and other characteristics of the corrugated or paperboard material of which the box is to be made, the scorelines S-1 through S-5 may be formed as press scores. However, as the rib elements R-1 and R-2 will be formed into a concave section of the forming mandrel by "back" bending relative to one another about the scoreline S-4, it may be desirable in some cases, depending on the nature of the material, to form the scoreline S-4 as a slit score in order to facilitate bending of the material from the "back" side, as it were.

The body blank W is essentially conventional in configuration. The flat blank is cut and formed with scores to define a rectangular bottom wall area B flanked at two opposite sides by integral bottom flaps F-2 and flanked on the two other opposite sides by sidwall; areas S. Each of the rectangular side wall areas S is formed with a pair of end flaps F-1 in alignment with the pair of flaps F-2. As is indicated in FIG. 1, the flat preformed blank W passes under a glue gun means N to have a series of parallel beads of glue G deposited theron. As will be apparent to those in the art, the distribution of the glue beads G is such that those areas of the side walls S which will come into contact with the laminator tab areas M-1 and M-2 and the flaps F-1 and F-2 which will come into contact with the end wall areas A of the pair of end panels preferably will have a plurality of beads of glue G deposited thereon.

While other orientations are possible, it is preferred that the three parts to be formed into a Bliss box proceed in the directions indicated in FIG. 1. Thus, the end panels E are initially oriented in parallel vertical planes and descend vertically in unison to a first arrested position. In this connection, while in the interest of clarity the figure shows each of the end panels in two different phases of formation, i.e, a first phase in which each flap has been deflected inwardly approximately 60° relative to the wall area A and then a second step of manipulations which complete the formation of the post rib and laminator areas, it should be understood that both phases take place at different times in a single arrested position of each end panel. Thereafter, the pair of fully formed end panels proceed downwardly into registration with the bottom area B of the flat body blank W and then all three parts are thrust by a mandrel into a die cavity which effects wrapping of the blank W around the preformed end panels E. Thus, but one mandrel is required to form all three pieces into a post reinforced Bliss box.

FIGS. 2 through 9 show one embodiment of machine elements of the invention for carrying out the sequence of operative steps schematically shown in FIG. 1.

Referring particularly to FIGS. 2 through 5, the machine has an upright rigid framework 30 which, at a pair of opposite sides of its upper end, is fitted with a pair of end panel supply magazines 32. Between the opposing inner ends of the magazines 32, the machine is fitted with a vertically reciprocable mandrel assembly 34, whose lower end comprises a mandrel 36. Beneath the mandrel assembly 34, the machine is fitted with a rigid stationary assembly defining a die cavity 38, indicated in phantom outline in certain figures for purposes of clarity. As is particularly shown in FIG. 4, the die cavity 38 is fitted with an opposite pair of edge guide and support means 40 for supporting a flat body blank W in an indexed position relative to the mandrel 36 and die cavity 38.

The machine frame 30 rigidly mounts a vertically disposed fluid powered cylinder 42 adapted for reciprocating an internal piston drivingly connected to a piston rod 44 that extends through the lower end of the cylinder housing. The mandrel 36 is fixedly secured to the lower end of the piston rod 44 to reciprocate therewith. It will of course be understood that the axis of reciprocation of the piston rod and mandrel intersects the center of the die cavity 38. The range of reciprocation of the mandrel is indicated by the directional arrows 46 in FIGS. 2 and 4. It will be noted that in the fully extended position of the mandrel 36, as in FIG. 3, the mandrel 36 is disposed within the die cavity 38. When the mandrel 36 is in the fully retracted position, as in FIG. 2, its bottom face is spaced above the die cavity 38 while its upper face is spaced beneath the end panel magazines 32.

Also disposed within the gap between the lower face of the magazines 32 and the die cavity 38 are machine elements for folding and forming the flaps F of the end panels E. Thus, in four positions corresponding to the four corners of the box to be formed, the machine frame mounts a cam shoe 50 and a rib or post forming mechanism 52, the characteristics of which will be set forth in detail as the description proceeds.

The mandrel 36 is essentially a polyhedron having a series of convex and concave faces. Preferably, the mandrel is symmetrical about its two mutually perpendicular axes and, accordingly, but one corner area thereof will be described in detail.

The mandrel faces define essentially a negative impression of the internal cross section of the completed box. It will be understood that its precise shape varies in accordance with the particular box to be made. Accordingly, in the case of the box L of FIG. 1 the mandrel 36 at each end includes: an end wall 54 against which the end wall A of end panel E is formed; a wall 56 against which the flap area P-1 is formed; an area 58 against which the flap area M-1 will be formed; a concavely related pair of flat surfaces 60 into which the rib areas R-1 and R-2 will be formed; and an area 62 against one half of which the laminator tab M-2 will be formed.

The mandrel assembly 34 is formed with an integral superstructure comprising upward extensions of the wall areas 54 and 56 at each of the opposite ends of the mandrel. Thus, when the mandrel 36 is in fully retracted position, as in FIG. 2, this pair of superstructure elements projects upwardly in confronting relationship to the pair of end panel magazines 32. As shown, each arm of the superstructure is fitted with a pair of vertically spaced apart upper pawl 66 and lower pawl 68. Each of these pawls is adapted to be only unidirectionally drivingly engageable with an upper edge of a single end panel E. Thus, each has a mechanical stop to limit the extent to which its downwardly facing driving edge 70 may project. Each pawl at its root end, and on the inside of the superstructure arm, is fitted with a torsion spring 72 normally biasing the corresponding pawl to an outwardly projecting position. The space between a pair of pawls 66 and 68 is at least as great as the corresponding dimension of an end panel E.

A variety of mechanisms are known in the prior art for holding a supply of flat blanks and feeding them, one at a time, off of one end of the supply. Suffice it to say that each of the end panel magazines 32 contains a supply of the end panels E that are biased inwardly against a stop means at the inner end or gate of the magazine and from which end one panel E at a time is stripped out of the magazine upon descent of the mandrel assembly 34 by an upper feed pawl 66. Thus, as the assembly 34 descends from the position of FIG. 2 to the fully extended position of FIG. 3, each of the upper pawls 66 strips a single one of the end panels E out of a magazine 32 to advance it to the intermediate position shown in FIG. 3. During an initial increment of this advance, each of the cam shoes 50 bodily turns the corresponding flap F inwardly about the scoreline S-1 until the flap portion P-1 comes into abutment with the corresponding face 56 of the mandrel. Thereafter, upon continued descent of the end panel, each cam shoe 50 further bends that portion of the flap outboard of the score line S-2 to an attitude displaced approximately 60° relative to the plane of the end wall portion A.

Figure 5:
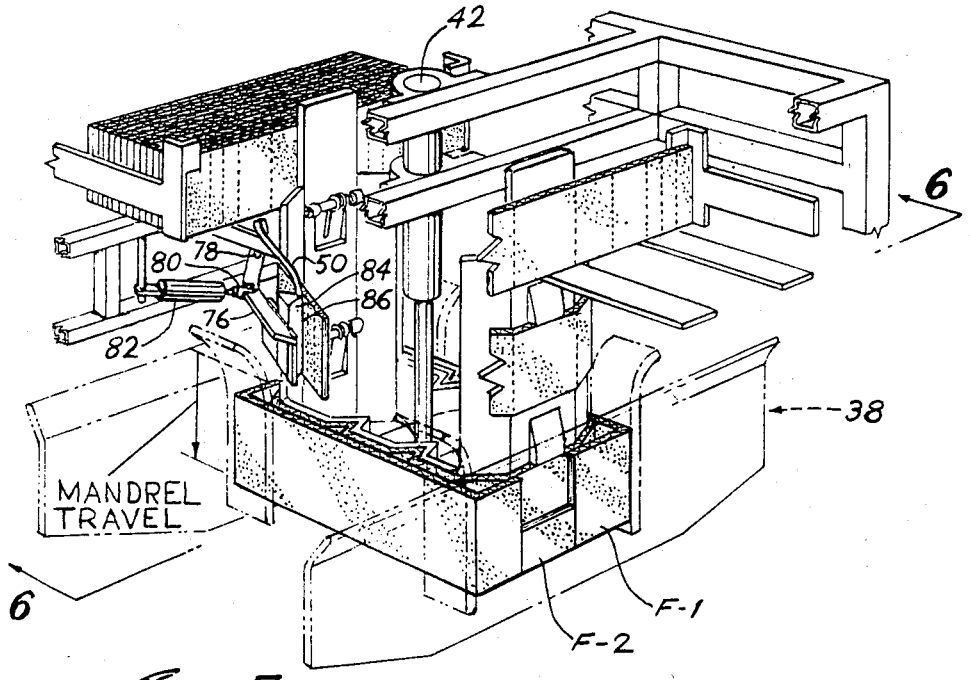

Each rib shoe mechanism assembly 52 comprises an angularly shaped pivot arm 76 having one end pivotally connected, as at 78, to a portion of the machine frame. At about its midpoint, the arm 76 is pivotally connected, as by a yoke 80, to the end of a piston rod of a pneumatic or other fluid powered cylinder 82 whose rear end is pivotally connected to another portion of the machine frame. The swingable end of the arm 76 is rigidly fitted with a triangularly shaped rib shoe 84 disposed parallel to the axis of reciprocation of the mandrel cylinder 42. The cylinder 82 reciprocates the rib shoe 84 inwardly and outwardly relative to the mandrel 36, into and out of registration with a concave portion thereof defined by the pair of faces 60. In the retracted position of the rib shoe 84, as indicated in FIG. 5, an apical edge 86 thereof is positioned as a vertically downwardly extending continuation of the terminal inner end of the corresponding cam shoe 50. Thus, when an end panel E has been advanced by a pawl 66 to the position in FIG. 5, the corresonding end panel flap F is primarily held in about 60° offset position, relative to end wall area A, by the apical edge 86.

Figure 3:
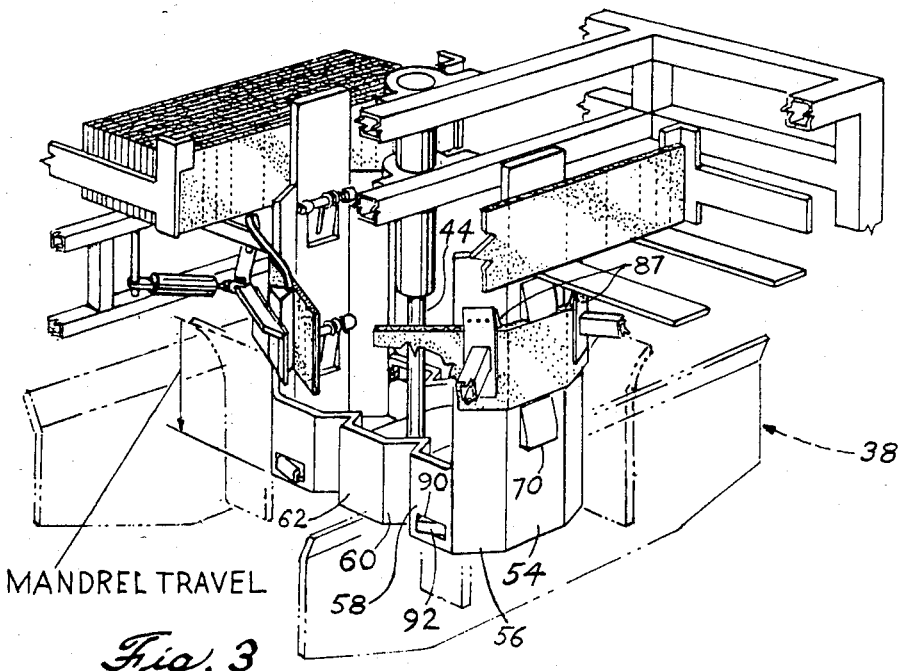
Figure 4:
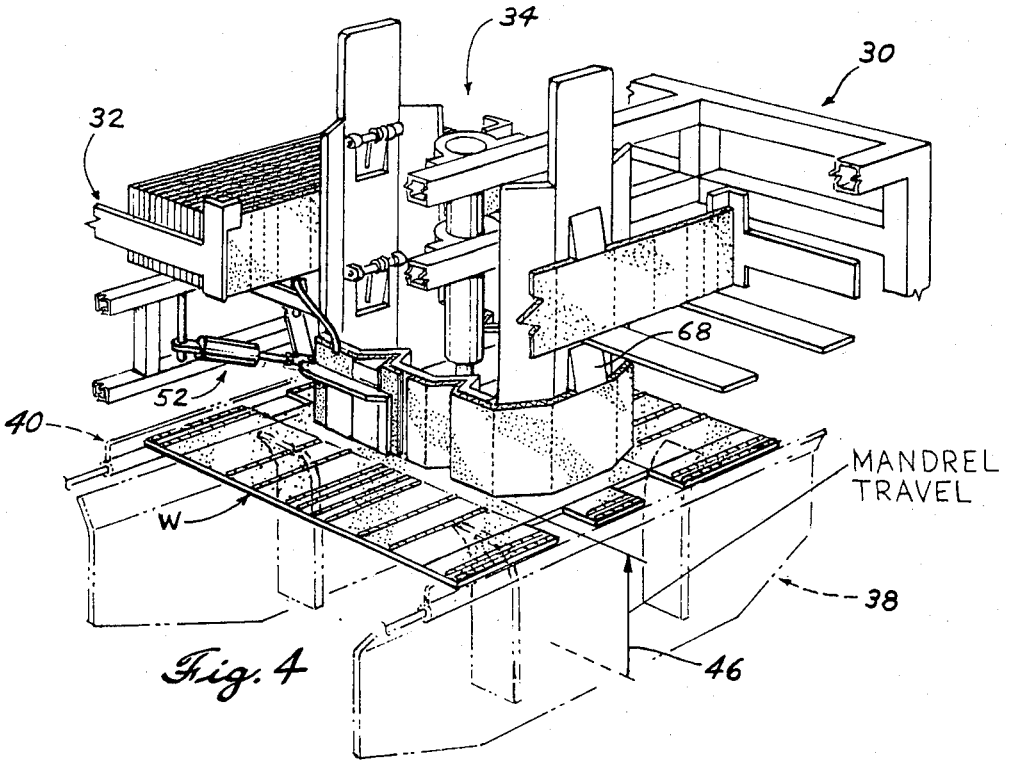

As indicated in FIG. 3, the machine frame supports, at each corner area, at least one leaf spring steel hold-down 88 to yieldably maintain a partially folded end flap E in position as the mandrel 36 rises from the fully extended position of FIG. 3 to the fully retracted position of FIG. 4. Thus, the mandrel ascends into registration of its opposite ends with an opposite pair of partially folded end flaps E. Thereafter, a single body blank W is fed into properly indexed position beneath the mandrel and over the die cavity 38. As the mandrel ascends into this position the lower pawls 68 are deflected inwardly by the restrained end panel E until the pawl passes above the upper edge of the end panel. Thereupon, the corresponding spring 72 biases the lower drive edge 70 of the lower pawls into position against the upper edge of the corresponding end panel.

Figure 9:
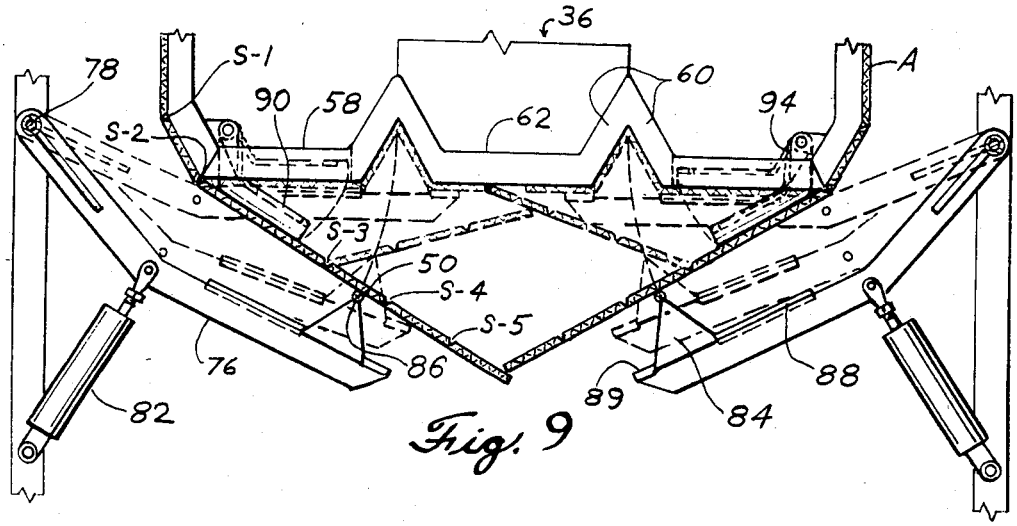
FIG. 9 is a partial plan view of one side of the mechanism shown in FIG. 8 and, also, showing in phantom outline different positions in the sequence of operation of a pair of the rib forming assemblies.

Referring to FIG. 3, it will be seen that each wall area 58 of the mandrel is formed with an opening 90 therethrough in which a plate 92 is pivotally mounted. As shown in FIG. 9, each plate 92 is resiliently biased by a spring 94 to the protruding position shown in the figure and is pivotable at a root end disposed adjacent the junction between the wall areas 56 and 58. The upwardly facing edge of each plate 92 is faired so that upon upward movement of the mandrel from the position of FIG. 3 to the position of FIG. 4 it will be engaged by the lower edge of a flap F of an end panel and be deflected inwardly. Each of the spring loaded plates 92 is an element in the sequential folding and forming of portions of the flap F outboard of a scoreline S-2, as indicated particularly in FIG. 9.

Figure 8:
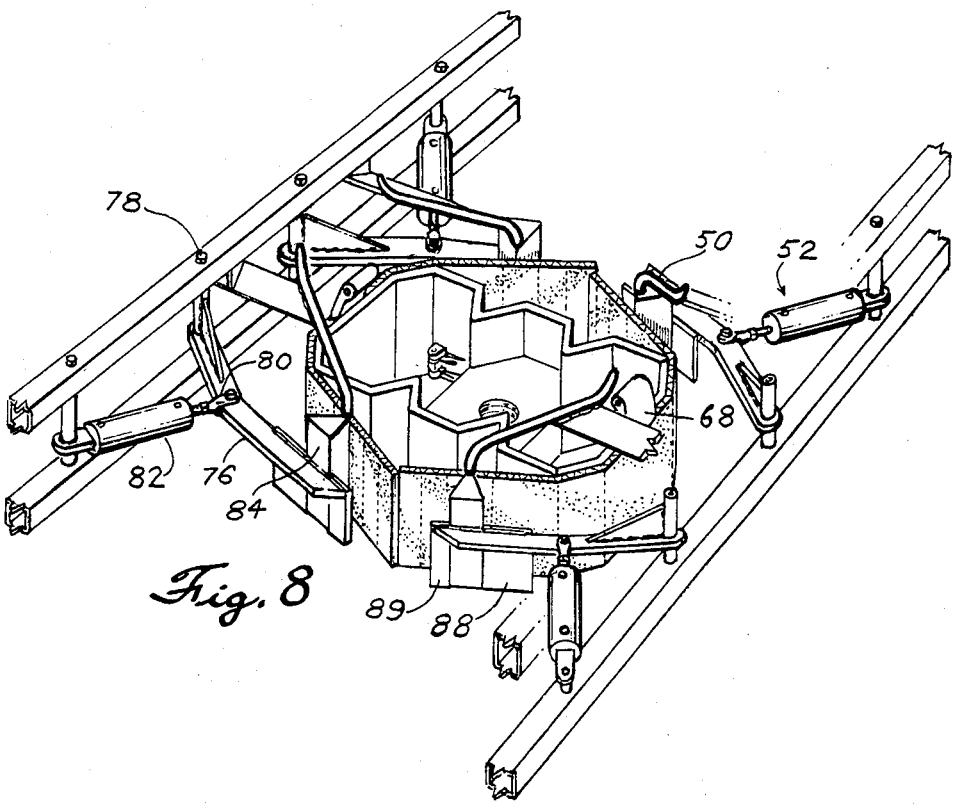
FIG. 8 is a partial perspective view of rib forming assemblies utilized in the machine of the invention.

As is shown in FIGS. 8 and 9, the pair of cam shoes 50 and rib mechanisms 52 on one side of the machine are adjusted differently than those on the other side of the machine in order to avoid interference between the flap portions F of a pair of end panels E in this stage of the process. For the same reason it may also be desired to actuate the pair of cylinders 82 on one side of the machine slightly in advance of those on the other side.

Referring to FIG. 9, each of the flaps F, outboard of the fold line S-2, is now disposed, by virtue of the guide means provided by the terminal end of the cam rod 50 and the apical edge 86 of the rib shoe 84, at approximately 60° relative to the plane of the end wall portion A. At the same time, the plate 90 is biased into contact with the inner face of the flap portion. Upon actuation of the cylinder 82 an initial increment of inward movement of the shoe 84 effects bending of the flap portion about the scoreline S-3 until the terminal edge of the flap engages centerwall 62 of the mandrel. In this connection, the spring 94 of the corresponding plate 90 is of a value such that the plate 90, in the area between the scorelines S-2 and S-3, is held essentially stationarily in place during folding relative to the scoreline S-3.

Upon continued inward movement of the rib shoe 84 to the fully extended position of the second dotted outline, as the terminal edge of the flap F is now bearing against the mandrel the apical edge 86 of the shoe 84 swings into mating registration with the concavity defined by the corresponding mandrel walls 60, thus forcing the rib areas R-1 and R-2 into the concavity. At the same time, plates 88, 89 flanking the base edge of the shoe 84 insure that the laminator areas M-1 and M-2 of the flaps are pressed into flat engagement with the mandrel walls 58, 62. Each of the end panels E is thus fully preformed, as indicated in FIG. 4 to which reference should now be made.

While the cylinders 82 remain actuated to maintain the rib shoes 84 in fully extended position, the mandrel cylinder 42 is now actuated to force the mandrel 36 downwardly to the fully extended position of FIG. 5. As a result, lower pawls 68 carry the preformed end panels E down into registration with the flat body blank W. During this descent of the mandrel the three parts of the box are brought together and fully erected in a manner best seen in FIGS. 6 and 7.

Figure 6:
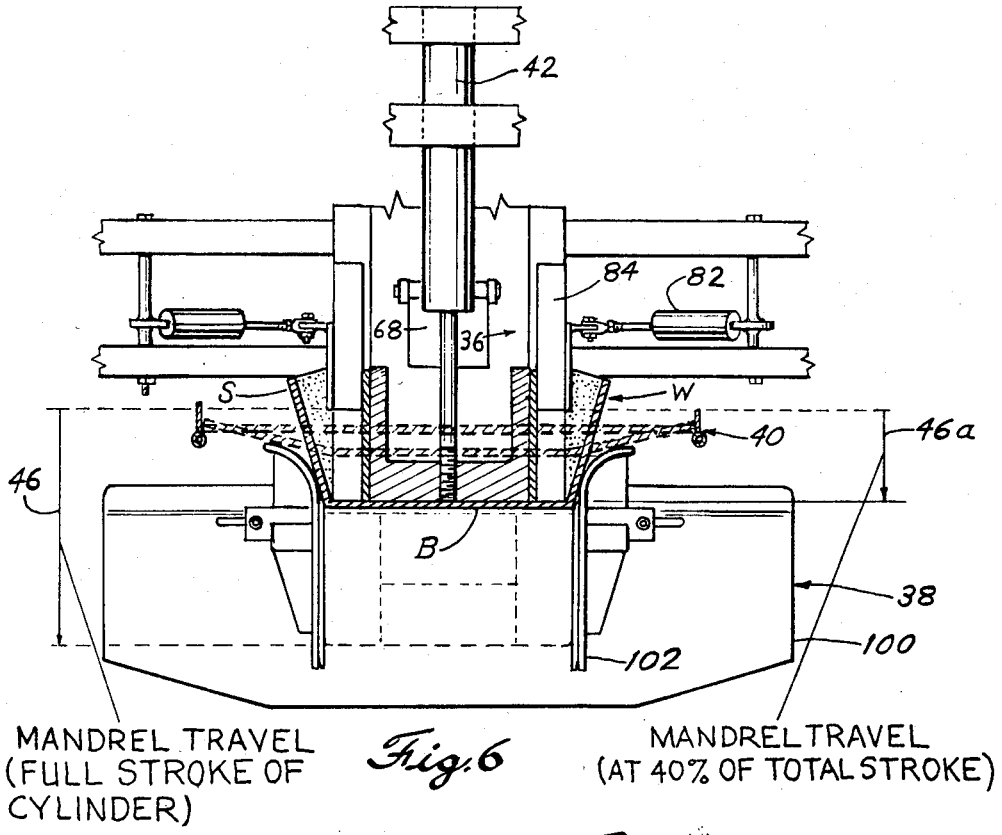
FIG. 6 is a partial sectional view, taken on the line 6—6 of FIG. 5, but with the parts in different relative positions.
Figure 7:
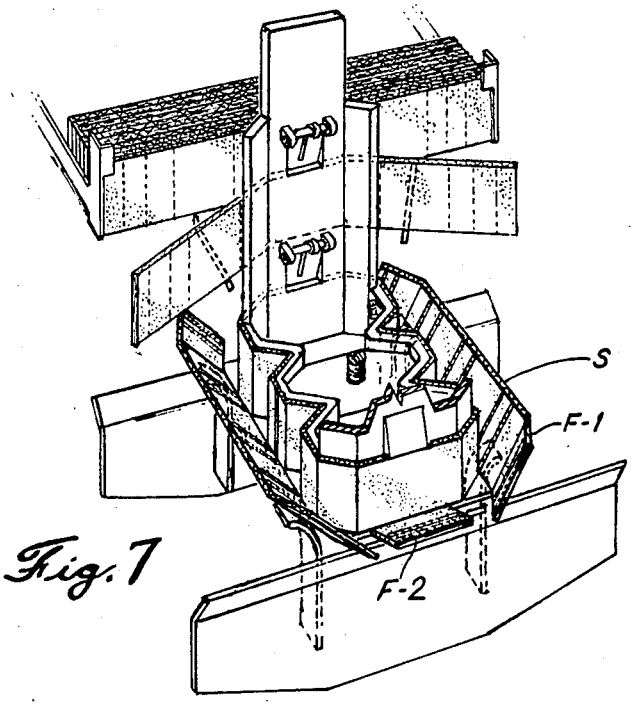
FIG. 7 is partial perspective view of the machine elements in positions approximately corresponding to FIG. 6.

Referring to FIG. 6, the die cavity 38 may be of the construction shown in my U.S. Pat. No. 4,345,905. In any event, the die cavity consists of structural elements defining four sides of the cavity, such as an opposed pair of die plates 100 and opposed sets of side fold shoe mechanisms 102. As is well known, and as indicated in FIG. 7, the upper ends of these elements are flared upwardly and outwardly such that when the mandrel 36 forces the flat body blank W thereinto the opposite sidewalls S and flaps F-1 and F-2 are progressively folded upwardly and into adhesive contact with confronting wall areas of the pair of preformed end panels carried on the mandrel. During this final step of the formation of the box, the pair of end panels interact with the folding body blank W and the parts of the die cavity 38 cooperate with the rib fold shoes 84 such that the end panels remain precisely located in registration with the body wrap W throughout the folding operation.

More particularly, referring now to FIG. 6, it will be observed that the body blank W is shown in phantom outline in both flat and partially folded conditions, as well as in a more folded condition in solid outline. The solid outline configuration of the blank W illustrated and the corresponding portions of an end panel E illustrated are in the positions which they assume at approximately 40% of the full stroke of the mandrel, as indicated by the directional line **46*a*. It will be observed that as the rib shoes 84 are in the fully extended position they have remained in contact with the upper portions of the ribs R being formed. The lower ends of the ribs, even in the first slightly folded condition of the body blank W, are maintained in place by their engagement with that scoreline defining a junction between the bottom area B of the blank W and a sidewall S. This condition obtains at the lower ends of the ribs since the upper ends of the side fold shoes 102 have already initiated turning moments on the sidewall areas S of the body blank. When the parts reach the 40% stroke condition indicated by line 46*a*, the ribs are still more firmly secured in place by the side fold shoes 102 while still being mechanically maintained in place by virtue of the continuing extended position of the shoes 84. When the mandrel reaches the fully extended position of FIG. 5, compressive pressures are applied to the die plates 100 and/or side fold shoes 102** whereby the parts are finally adhesively secured together.

Figure 23:
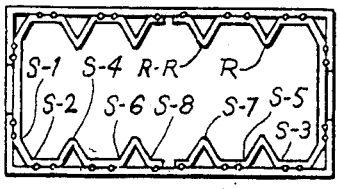
Figure 24:
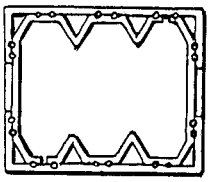
Figure 25:
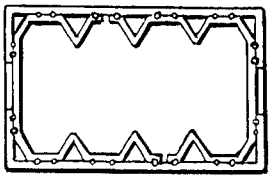

FIGS. 19 through 25 show some of the variety of Bliss boxes that can be made with the invention. It will be noted that in some cases, as in FIGS. 20, 21 and 23, the pair of end panel blanks are symmetric. In some cases, irrespective of symmetry, one or both of the flaps of an end panel have been formed with a pair of intermediate ribs. Thus, in the case of the box of FIG. 23, each flap of an end panel has been formed into a rib R-1 in addition to the first rib R. As is indicated in FIG. 23, each flap F is formed with additional parallel spaced apart score lines S-6 through S-8 to define the additional rib and laminator tab areas of the flap. A means of achieving this result is shown in FIGS. 10–14.

As indicated in these figures, the means for forming a pair of ribs in a given flap is largely a matter of duplicating the rib folder mechanisms. There are, however, some complexities arising from the fact that the flap is successively folded, progressing from scoreline S-1 through scoreline S-8. Accordingly, the mechanism is shown in some detail but with similar parts identified by similar identification numerals.

Figure 11:
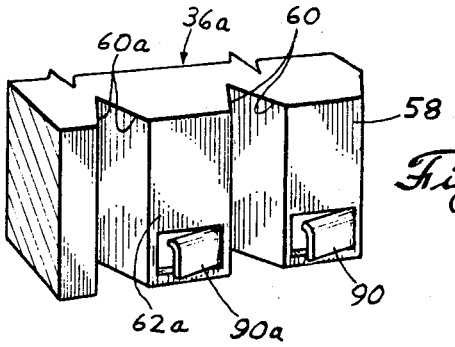
FIG. 11 is a partial perspective view, with parts broken away, of a modified form of mandrel for use with the embodiment of FIG. 10.

Referring to FIG. 11, the mandrel **36*a* is formed with an additional rib concavity defined by a pair of angularly related surfaces 60*a*. In addition, the mandrel mounts a second spring biased plate 90*a* in its wall 62*a*. The first spring biased plate 90 cooperates with a first rib folding mechanism 52*a*, while the second plate 90*a* coacts with a second rib folding mechanism 52*b***.

The rib folding mechanism **52*a* is essentially identical to the folding mechanism 52 except that it carries only a single pressure plate 88*a*, the plate 89 having been omitted. The folding mechanism 52*b* is essentially the same as the mechanism 52*a* except that its arm 76*a* is of a greater radius than the arm 76 in order to position the rib shoe 84*a* for movement into and out of the mandrel concavity defined by the mandrel walls 60*a*. The rib shoe 84*a* is flanked by pressure plates 88*a* and 89*a***.

Figure 12:
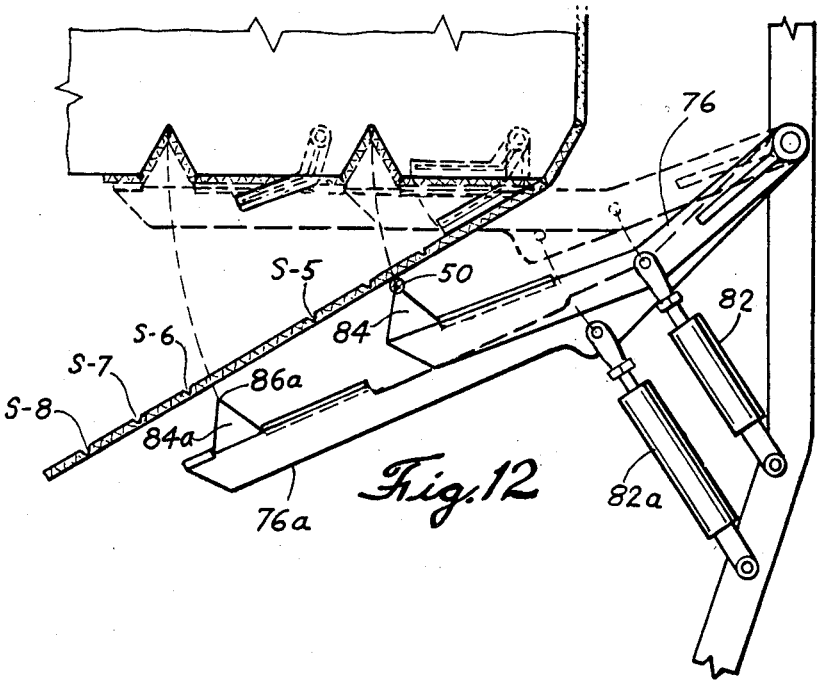
FIGS. 12–14 are partial top plan views of the mechanism of FIG. 10 showing the parts in different phases or stages of operation.
Figure 13:
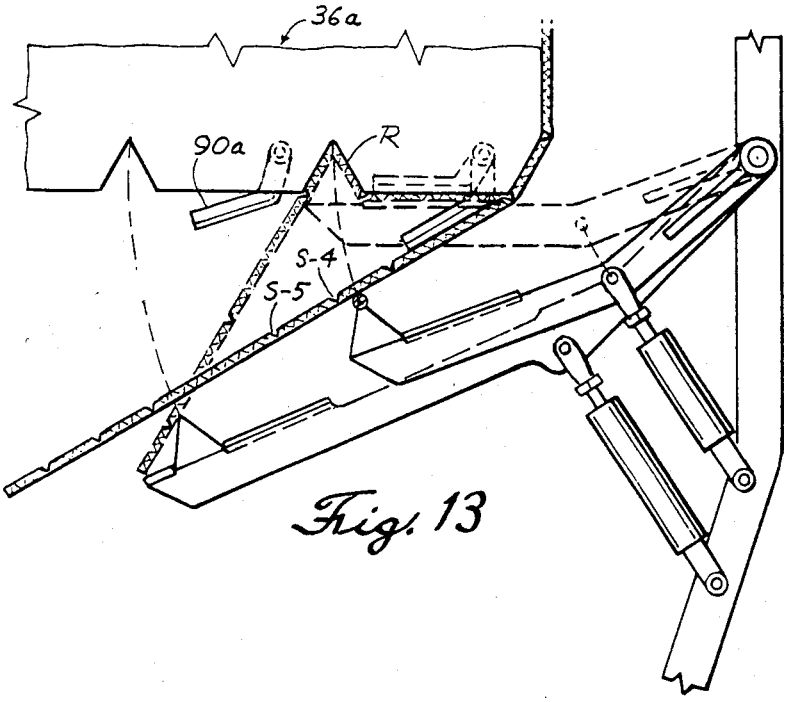
Figure 14:
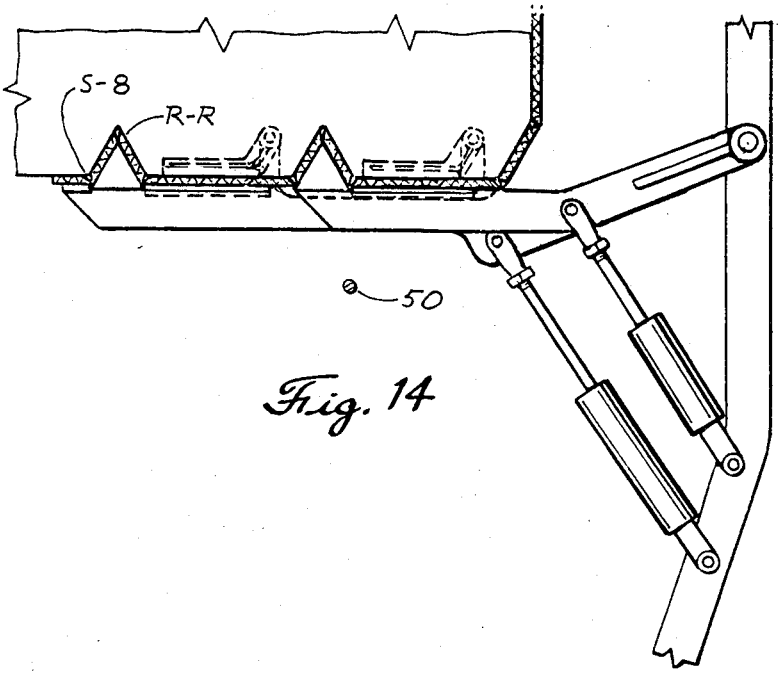

As shown in FIG. 12, the folding mechanism 52*a* is actuated first. As a result, as indicated in FIG. 13, the first rib R is fully formed by the rib shoe 84. However, it is to be observed that by virtue of the absence of the pressure plate 89 that the portion of the flap outwardly of the scoreline S-5 projects outwardly away from the face of the mandrel 36*a*. The terminal portion of the flap is then in interfering alignment with rib shoe 84*a* of the rib folding mechanism 52*b*, which is then actuated. The shoe 84*a* thus effects inward turning of the outer flap portion towards the spring biased shoe 90*a*. The resistance of the plate 90*a* thus effects folding about the scoreline S-6, in the manner previously described in connection with FIG. 9. Continued inward movement of the shoe 84*a* finally effects forming of the rib R-1, as indicated in FIG. 14. At the same time, the pressure plate 89*a* effects turning of the terminal flap portion about the scoreline S-8.

As can be seen from FIGS. 9 and 12, the rib folding shoes 84, 84*a* swing on radii which will bring their apical edges 86, 86*a* into precise registration with the apex of the die faces 60, 60*a*. However, this has a disadvantage with some materials in that in the solid outline positions of the flaps indicated in FIGS. 9 and 12, the apical edges of the shoes 84, 84*a* are not in registration, initially, with the fold lines S-4 and S-7 about which the rib defining material of the flap is bent reversely or from the back side. If a slit score rather than a press score is used for the scorelines S-4 and S-7, the mechanism will work satisfactorily with most materials. With heavier materials the preferred embodiment of fold shoe mounting shown in FIGS. 15–18 should be employed.

Figure 10:
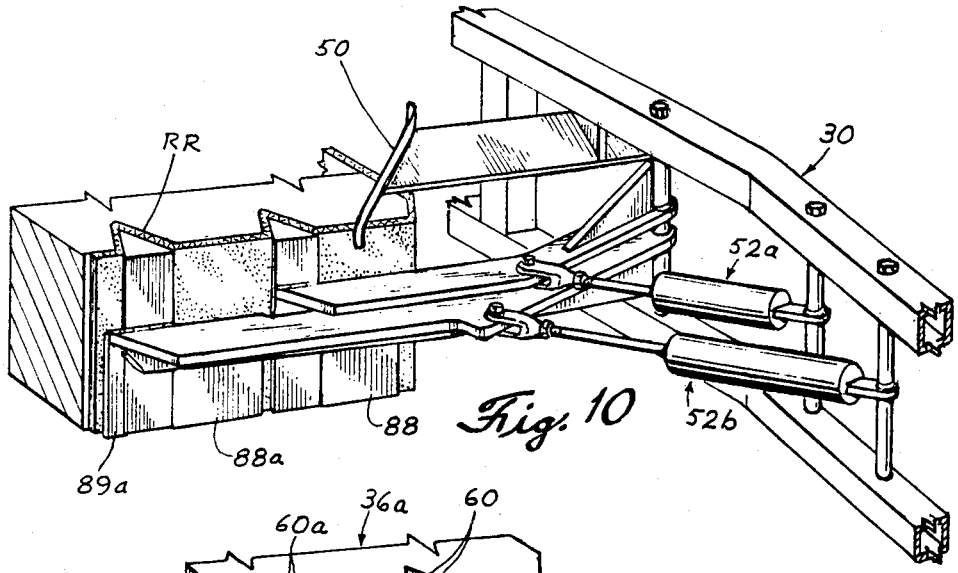
FIG. 10 is a partial perspective view of an alternative form of rib forming assembly as adapted for forming a pair of ribs in each corner area of the Bliss box.
Figure 16:
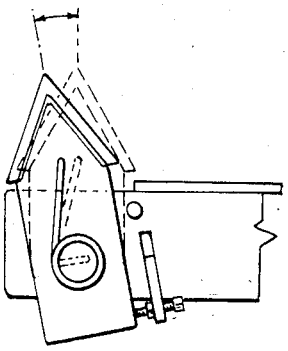
FIG. 16 is a top plan view of the mechanism of FIG. 15.
Figure 17:
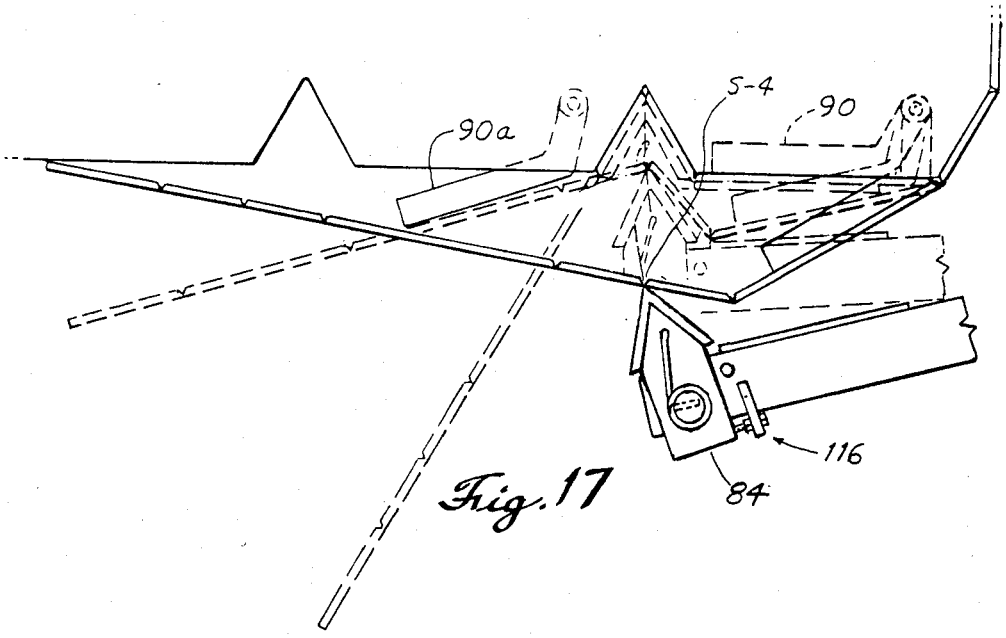
FIGS. 17 and 18 are plan views similar to FIGS. 12–14 but, also, illustrating in both solid and phantom outline different phases in the formation of a pair of ribs in a corner region of an end panel for a box.
Figure 18:
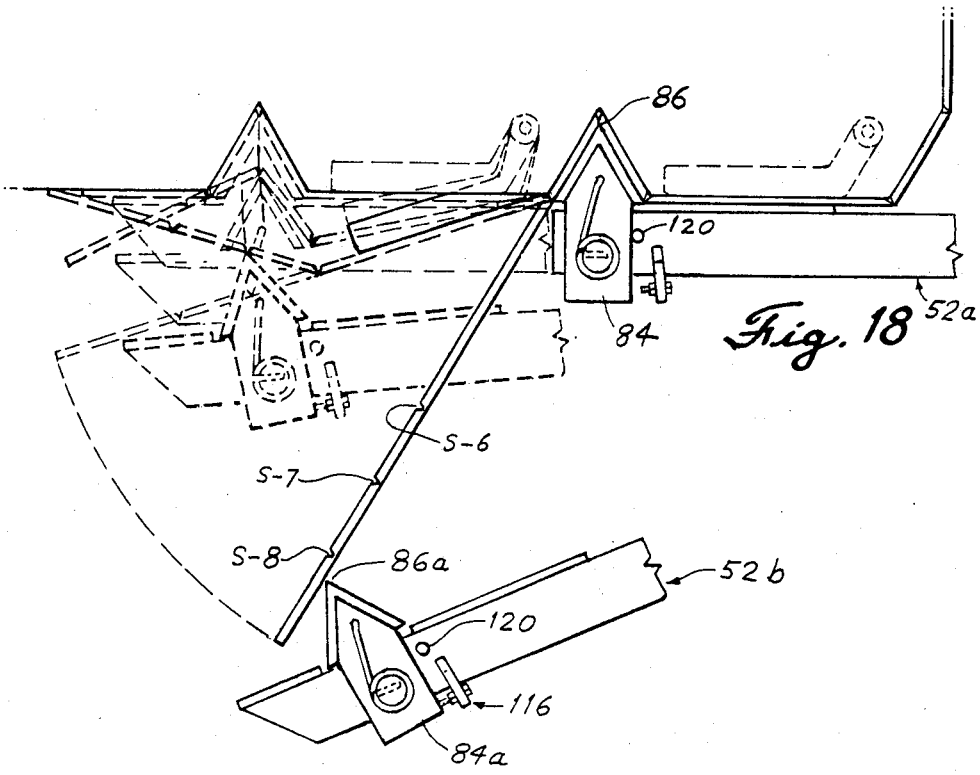
Figure 19:
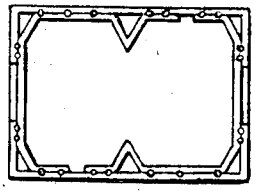
FIGS. 19–25 are top plan views of an illustrative variety of internaly reinfoced Bliss boxes made in accordance with the process and machine of the invention.
Figure 20:
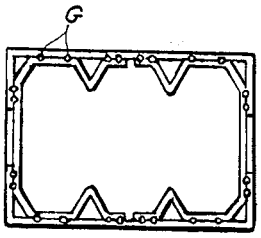
Figure 21:
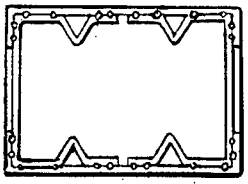
Figure 22:
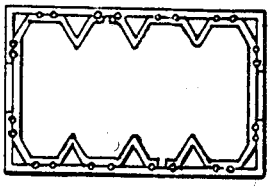

FIGS. 17 and 18 show the same two rib folding mechanisms 52*a* and 52*b* of FIG. 10 except that each has a modified mechanism of mounting the corresponding rib shoe 84, 84*a*. The modified mechanism is best seen in FIGS. 15 and 16.

Figure 15:
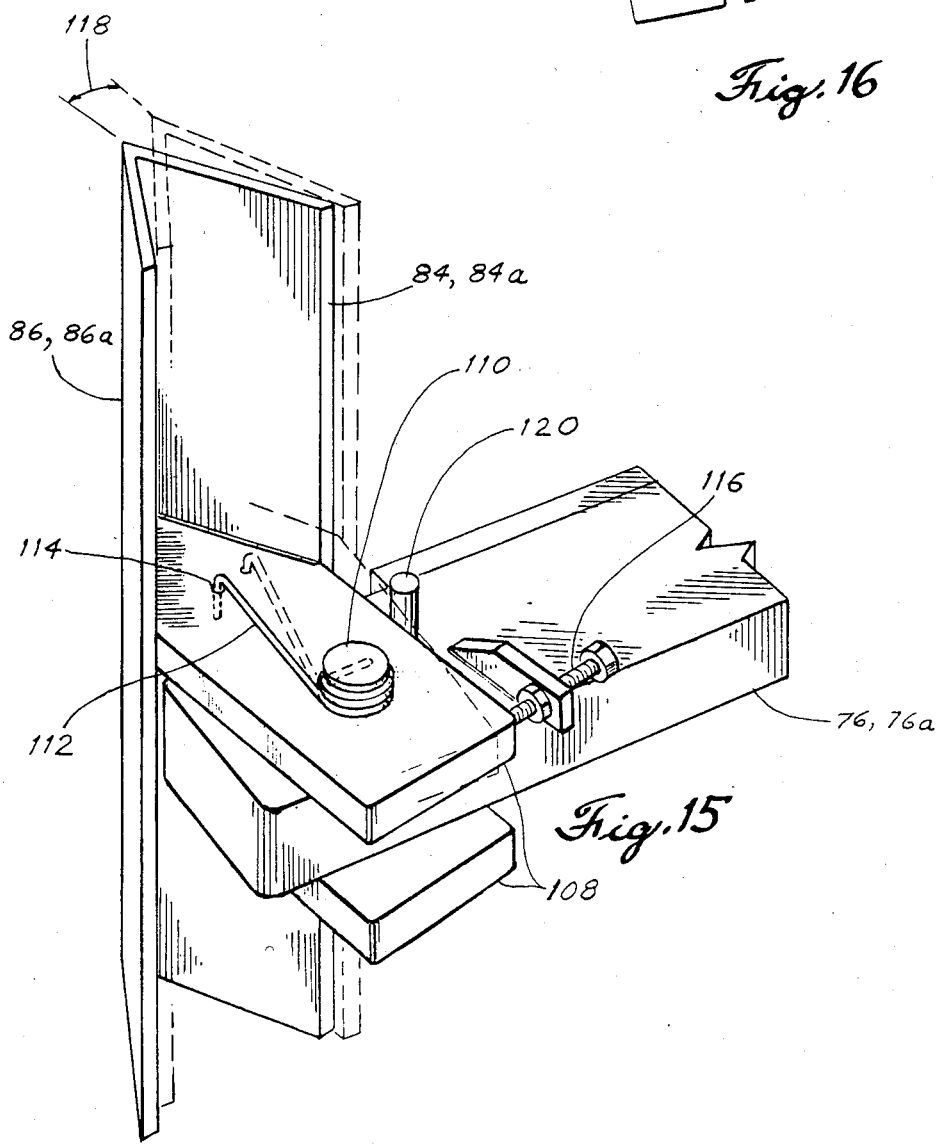
FIG. 15 is a partial perspective view, on a larger scale, of one of the rib forming elements.

Referring to FIG. 15, the shoes 84, 84*a* take the form of angularly related plates including an angle equal to the angle of the concavity of the mandrel into which they are to be swung. On the back side of the shoe, at about the midpoint, each has a pair of rearwardly projecting spaced apart plates 108 which slidably embrace the terminal end portion of the mounting arm 76, 76*a*. The shoe 84, 84*a* is pivotally mounted in place by a pivot stud 110 which passes through the arm 76, 76*a* and plates 108. The stud 110 mounts a torsion spring 112 having a radially projecting terminal arm that is pinned to one of the plates 108, as indicated at 114. The spring 114 normally biases the shoe 84, 84*a* to the solid outline position shown and against an adjustable stop means 116 secured to a face of the mounting arm 76, 76*a*. As indiciated by directional arrow 118, the apical edge 86, 86*a* of a shoe is thus moveable through an arc, the other extreme of which is dictated by a pin 120 fixed in position on a face of the mounting arm 76, 76*a*.

As shown in FIGS. 17 and 18, the mode of operation of the rib folding shoes 84, 84*a* is essentially the same as that depicted in FIGS. 10–14 except that now the apical edges 86, 86*a* come into registration with the scorelines S-4, S-7 at the time in which reverse bending about the scorelines occurs. Thus, as shown in FIG. 17, when portions of the flap outboard of the scoreline S-3 have been bent, relative to the plate 90, the shoe 84 has its apical edge 86 precisely in registration with the scoreline S-4. As the shoe 84 moves inwardly, its apical edge 86 remains in registration with the scoreline S-4, being captured by the corrugated or paperboard material. In effect, the apical edge 86 proceeds inwardly along a diminished radius, as indicated by the solid outline position of FIG. 18.

As shown in FIG. 18 essentially the same thing happens with respect to the rib shoe 84*a*. Thus, as shown in the phantom outline position next inward from the solid outline position, when the portion of the flap outboard of the scoreline S-5 has been folded relative to the spring biased plate 90*a* the apical edge 86*a* of the shoe is in registration with the backside of the scoreline S-7. Again, as the shoe 84*a* progresses inwardly, the radius of the apical edge 86*a* is changed to the extent permitted by the fixed stop 120.

I claim:

1. A process of forming a Bliss box that includes the steps of:

partially turning an end flap of an end panel towards a side wall of a retracted reciprocable mandrel;

reversely folding a pair of adjacent rib areas of the flap into a rib configuration about a common scoreline and into mating registration with a concave depression in a side wall of the retracted mandrel while futher turing the flap towards the side wall of the mandrel; and while maintaining the rib configuration of the rib areas, extending the mandrel out of retracted position into a die cavity while erecting a body wrap by means of the die cavity around the so formed end panel;

whereby a portion of a sidewall of the erected body wrap and the part of rib areas of the end wall flap define a hollow rib of the formed Bliss box.

2. The process of claim 1 in which:

extending the mandrel drives a second end panel into the position formerly occupied by the first mentioned end panel.

3. The process of claim 2 further comprising:

retracting the mandrel out of the formed Bliss box to the retracted position in readiness to subsequently have a flap area of the second end panel formed into a rib configuration thereon while the mandrel is in the retracted position.

4. A process of forming a Bliss box out of a pair of end panels and a body wrap, each of the end panels having a central wall area flanked by a pair of integral end flaps, each of the end flaps having at least three parallel scorelines dividing the flap into a first laminator tab area, a pair of rib areas and a second laminator tab area, and the body wrap having a bottom panel area flanked by opposite side wall areas, comprising:

superpositioning the pair of end panels in alignment with the opposite ends of the botttom area of the body wrap;

for each flap of the end panels;

folding the flap bodily inwardly against a corner of a mandrel through less than 90° relative to the central wall area;

while yieldably opposing further inward turning of the flap in the first laminator tab area, applying an inward turning force on the flap beyond the first scoreline to further inwardly turn the rib areas and second laminator tab area about the first scoreline;

applying the inward turning force to the second scoreline to reversely bend the rib areas relative to one another and into a concave depression of the mandrel while moving the laminator tab areas into positions at substantially 90° to the central wall;

and forming the body wrap about the pair of end panels with the sidewalls of the body wrap against the laminator tab areas.

5. The process of claim 4 as applied to said body wrap and to a pair of said end panels, each of which end panels has each flap further scored to define a corner post area between the central wall area and the first laminator tab area, the process being characterized by:

in folding the flap bodily inwardly, first pressing the corner post area against a convex corner face of the mandrel.

6. The process of claim 4 as applied to said body wrap and to a pair of said end panels, each of which end panels has each flap further scored with fourth, fifth and sixth scorelines to define a second pair of rib areas and a third laminator tab area of the flap beyond the second laminator tab area, the process being characterized in that:

after applying the inward turning force to the second scoreline to reversely bend the first mentioned rib areas into the concave depression of the mandrel and substantially concurrently with moving the second laminator tab into a position at substantially 90° to the central wall area, while yieldably opposing further inward turning of the second laminator tab area, applying an inward turning force on the flap outwardly from the fourth scoreline to further inwardly turn the second mentioned rib areas and third laminator tab area about the fourth scoreline;

applying an inward turning force to the fifth scoreline to reversely bend the second mentioned rib areas realtive to one another and into a second concave depression of the mandrel while moving the third laminator tab into a position at substantially 90° to the central wall area.

7. In a machine for forming a Bliss box, the improvement comprising:

a mandrel and a die cavity coaxially mounted in a common frame;

means operatively connected to said mandrel to reciprocate said mandrel between extended and retracted positions into and out of said die cavity;

a concave depression formed in at least one of the side faces of said mandrel, said depression being in alignment with the axis of reciprocation of said mandrel;

a rib forming means carried by said frame in a position to be extendable and retractable into and out of mating registration with said depression when said mandrel is in said retracted position for reversely bending a pair of rib areas of an end flap of an end wall panel into a rib confirguration within said depression;

means operatively connected to said mandrel to extend and retract said rib forming means;

said mandrel having a convex face between a corner thereof and said concave depression; and said convex face mounting a means for yieldably opposing the movement of an area of a flap of an end wall panel into flush engagement with said convex face, whereby rib areas of the flap beyond said yieldable means can be folded relative to the first mentioned area of the flap.

8. The machine of claim 7 wherein:

said mandrel is formed in its side faces with at least one of said depressions adjacent each corner of said mandrel; and said frame mounts at least one of said rib forming means adjacent each corner of said mandrel.

9. The machine of claim 7 wherein:

said mandrel is formed in at least one of its side faces with a pair of said depressions adjacent one corner at least of said mandrel; and said frame mounts a pair of said rib forming means adjacent said one corner;

said pair of rib forming means at said one corner being operable in a sequence for forming a pair of rib configurations in a sequence progressing from the corresponding corner of the mandrel toward the center of the corresponding side face of the mandrel.

10. The machine of claim 7 wherein:

adjacent said rib forming means, said frame mounts a means for camming an end flap of an end panel inwardly towards a side of said mandrel;

said rib forming means having an inwardly projecting apical edge that in a retracted position of said rib forming means comprises a continuation of a terminal end of said means for camming.

11. The machine of claim 7 wherein:

said mandrel has a means unidirectionally engageable with a pair of end panels formed therearound to drive the end panels into said die cavity upon extension of said mandrel;

said rib forming means being adapted to remain in extended position during a part at least of extension of said mandrel.

12. The machine of claim 7 wherein:

said die cavity is adapted to commence erecting the side walls of the body blank substantially concurrently with initial entry of said mandrel into said die cavity upon extension of said mandrel, whereby erection of the sidewalls of the body blank restrain the rib configuration against said side wall of said mandrel.

13. A machine for forming a rib configuration from rib areas of a box flap that are defined by a series of parallel scorelines across the flap, comprising:

a mandrel of polyhedral form having a concave depression in a face thereof, said depression being parallel to the axis of said mandrel;

means operatively connected to said mandrel to reciprocate said mandrel along said axis between extended and retracted positions thereof;

a rib forming means that is extendable and retractable into and out of mating registration with said depression to reversely bend a pair of rib areas of the flap into a rib configuration within said depression upon extension of said rib forming means; and means operatively connected to said rib forming means to extend said rib forming means into mating registration with said depression when said mandrel is in said retracted position, said means to reciprocate said mandrel and said means to extend said rib forming means being adapted to extend said mandrel away from said rib forming means along said axis while said rib forming means is held in registration with said depression by said means to extend said rib forming means.

14. The mechanism of claim 13 wherein:

said concave depression comprises an adjacent pair of angularly related flat surfaces; and said rib forming means comprises an elongate member of essentially triangular cross sectional configuration matingly complementary to said concave depression and oriented parallel to said depression.

15. The mechanism of claim 14 wherein:

a base edge of said rib forming element is fitted with a flat pressure plate extending in substantially the plane of said base edge.

16. The mechanism of claim 13 wherein:

said rib forming means is extendable and retractable on an arc wherein an apical edge of said rib forming means intersects a midline of said concave depression.

17. The mechanism of claim 16 wherein:

said rib forming means is yieldably offsettable from said arc.

18. In a process of forming a box having a side wall with a hollow rib, the rib comprising a portion of the side wall and rib portions of a flap at one end of a central wall area of an end panel, the flap having at least three parallel scorelines dividing the flap into a first laminator tab area, a pair of rib areas and a second laminator tab area, the steps of:

folding the flap bodlily inwardly against a corner of a mandrel through less than 90° relative to the central wall area of the end panel;

further inwardly turning the rib areas and second laminator tab area about the first scoreline and relative to the first laminator tab area to contact a side face of the mandrel with a terminal end of the second laminator tab area;

applying an inwardly directed force to the second scoreline to reversely bend the rib areas relative to one another and into a concave depression of the mandrel while moving the laminator tab areas into flush contact with the side face of the mandrel; and turning the sidewall into contact with the laminator tab areas.

19. The process of claim 18 chracterized by:

moving the mandrel from a retracted position into an extended position within a die cavity in order to effect said step of turning the sidewall into contact with the laminator tab areas.

20. The process of claim 19 further characterized by:

turning the flap of a second end panel bodily inwardly against a corner of the mandrel through less than 90° relative to the central wall area of the second panel prior to retraction of the mandrel out of the die cavity.

21. The process of claim 20 futher characterized by:

retracting the mandrel out of the die cavity to move the concave depression into registration with the flap of the second end panel before further inward turning of the rib areas and laminator tab areas of the second end panel.

* * * * *

UNITED STATES PATENT OFFICE

CERTIFICATE OF CORRECTION

PATENT NO. : 4,596,542

DATED : June 24, 1986

INVENTOR(S) : Lenard E. Moen

It is certified that error appears in the above-identified patent and that said Letters Patent are hereby corrected as shown below:

In col. 4, l. 22, "sidwall;" should read --sidewall--.

In Claim 1, l. 23, "turing" should read --turning--.

In Claim 1, l. 32, "part" should read --pair--.

In Claim 6, l. 36, "realtive" should read --relative--.

In Claim 7, l. 56, "confirguration" should read --configuration--.

Signed and Sealed this

Twenty-fourth Day of February, 1987

*Attest:*

DONALD J. QUIGG

*Attesting Officer*

*Commissioner of Patents and Trademarks*